United States Patent [19]

Netschert

[11] Patent Number: 4,858,627

[45] Date of Patent: Aug. 22, 1989

[54] SMOKER'S HAT

[76] Inventor: Walter C. Netschert, 5821 Beach Blvd., Buena Park, Calif. 90621

[21] Appl. No.: 198,335

[22] Filed: May 25, 1988

[51] Int. Cl.[4] ..... A24D 3/04; A24F 47/00

[52] U.S. Cl. ..... 131/329; 131/331; 2/171.3

[58] Field of Search ..... 128/863, 910; 2/171.3, 2/10, 436, 437; 131/329, 330, 331

[56] References Cited

U.S. PATENT DOCUMENTS

| | | | |
|---|---|---|---|
| 3,735,423 | 5/1973 | Droz | 2/171.3 |
| 3,813,696 | 6/1974 | Yeager | 2/171.3 |
| 3,822,698 | 7/1974 | Guy | 128/201.25 |
| 3,838,466 | 10/1974 | Poirier | 2/10 |
| 3,881,198 | 5/1975 | Waters | 2/171.3 |
| 3,955,570 | 5/1976 | Hotter | 128/863 |
| 4,055,173 | 10/1977 | Knab | 128/863 |
| 4,127,130 | 11/1978 | Naysmith | 128/201.25 |
| 4,133,308 | 1/1979 | Lowe et al. | 128/201.25 |
| 4,238,857 | 12/1980 | Waters | 2/171.3 |
| 4,280,491 | 7/1981 | Borg et al. | 128/201.24 |
| 4,411,264 | 10/1983 | Jacobson | 128/201.23 |
| 4,443,893 | 4/1984 | Yamamoto | 2/436 |
| 4,462,399 | 7/1984 | Braun | 128/201.25 |
| 4,498,202 | 2/1985 | Yamamoto | 2/424 |
| 4,546,496 | 10/1985 | Lewis | 2/171.3 |
| 4,605,000 | 8/1986 | Anguita | 128/201.25 |
| 4,681,244 | 7/1987 | Geddie | 222/175 |

*Primary Examiner*—V. Millin
*Assistant Examiner*—David F. Crosby
*Attorney, Agent, or Firm*—Walter A. Hackler

[57] ABSTRACT

A portable hat system enables the smoking of tobacco type products without affecting the environment includes a hat for covering the head of the smoker, an integral fan for intaking ambient air (contaminated and non contaminated) into the hat with this intake ambient air flowing in front of the smoker's face, a filtration, purification and deionization system for removal of combustion products, such as smoke odors and positive ions from the intake ambient air, and an exhaust system for expelling the filtered deodorized, deionized and optionally scented air from the hat.

23 Claims, 2 Drawing Sheets

10
12
16
18
20
22
24
26
28
32
36
40
42
46
48
52
60
64
66
70
72
76
78
80
82
84
86
90
92
100
102
106
110
112
116
120
122
124
126
128
130
134
136
140
142
146
150
152
156
158
160
164
170
172
176
178
180

SMOKER'S HAT

The present invention generally relates to portable air filtration and purification apparatus and is more particularly directed to a portable hat system which is suitable for gathering smoke exhaled upward by a smoker, removing odor and smoke particles from the air and returning the filtered and purified air to the surrounds of a user, thereby eliminating any objection to the smoking of cigarettes and the like by non-smokers in the area.

While the smoking of tobacco products, such as cigarettes, has been very popular over the years, a growing number of non-smokers find the aroma from cigarette smoke, and the associated smoke and ash product as a result of smoking quite objectionable.

This growing concern has prompted many governmental regulations as well as private company rules concerning appropriate times and places for smoking. This is unfortunate for the typical smoker because it has severally limited their use of tobacco products, and in many cases, has detrimentally affected their work habits, efficiency and potential for advancement and/or potential for new employment.

Unfortunately, for cigarette smokers, most occupations require interaction with a multitude of people, either individually or in conference. It is at these very times that a smoker still desires his or her cigarette, and it was not long ago that it was most socially acceptable to permit this.

Moreover, mass transit systems, such as commercial airlines, and social gatherings in theaters, restaurants, pubs, and the like, are other areas where a conflict between smoker and non-smokers wishes occur.

Because of the evolving social changes in our society, there is a need for a device to put the smoker and the non-smoker on equal footing. The present invention fills that need. A portable hat system is provided herein to enable the smoking of tobacco type products without disturbing or threatening nearby non-smokers.

SUMMARY OF THE INVENTION

A portable hat system for enabling the smoking of tobacco type products without affecting the environment, in accordance with the present invention, generally includes hat means for covering the head of a smoker, means for intaking ambient air into the hat means, means for removing combustion products released by the smoker, and means for exhausting the filtered air from the hat means. The intake ambient air flows in front of the smoker's face when the operating hat means is worn by the smoker, thereby gathering all the smoke products and delivering them to the means for removing combustion products.

More particularly, the portable hat system, according to the present invention, includes a lens/visor which is dependingly attached to the hat means and surrounding the face of the smoker when the hat means is worn by the smoker. In this manner, the visor provides a means of establishing an intake ambient air channel over the face of the smoker when the hat means is worn thereby. In addition, staging means may be provided for supporting a lit cigarette under the hat means in a position enabling the intake ambient air to flow therepast. Also, receptacle means may be provided and disposed under the hat means for receiving solid combustion wastes. The receptacle means is disposed in a position enabling the intake ambient air to flow therepast similar to the staging means hereinabove recited. Hence, the portable hat system provides a controlled environment which at all times captures and retains substantially all cigarette wastes.

It should be appreciated that since the staging means and the receptacle means are an integral part of the portable hat system, the present invention enables the user/smoker full opportunity to use his or her arms and hands during smoking without continuous lip contact with the cigarette. That is, the cigarette may be supported by the staging means, and ashed or extinguished in the receptacle, both of which are in the controlled environment of the portable hat system.

For use in construction areas, or the like, the hat means may also include hard hat means, such as reinforced plastic, or the like, for preventing injury to the smoker's head from falling objects when the hat means is worn by the smoker.

Specifically, the means for intaking ambient air may include a battery operated fan and rechargeable battery and the means for removing combustion products from the intake ambient air may include an electrostatic cathode screens, a removable filter/deodorizer cartridge and duct means for directing intake ambient air with combustion products through electrostatic cathode screens and through removable filter cartridge.

In order to provide comfort and ease of use of the present invention, the fan and the battery may be disposed in opposite ends of the hat means in order to balance the weight of the portable hat system, thereby causing the center of gravity thereof to be near the center of the smoker's head when the hat means is worn by the smoker. Hence, there is no inherent imbalance of the hat on the smoker.

As protection against the undesirable intake of fly ash or lit embers into the filtered cartridge, the means for intaking ambient air may also include cinder guard screen means for preventing the solid combustion products of a predetermined size from entering both the fan and the removable filtered cartridge.

To provide efficient removal of combustion products, an electrostatic cathode screen may be provided along with a removable filter/deodorizer cartridge. Duct means provide for directing intake ambient air and combustion products past the electrostatic cathode means and through the removable filter/deodorizer cartridge. It should be apparent that the removable cartridge enables the efficiency of the combustion product removal means to be maintained indefinitely.

Importantly, the means for removing combustion products from the intake air may also include recirculation duct means for enabling at least a portion of the intake ambient air to pass through the removable filter/-deodorizer cartridge more than once. This provides for partial recycling of filtered, or purified, air which also acts to increase a differential pressure across the filters for greater filter life and to further polish the discharge air between puffs of incoming smoke.

In situations where under hat humidity and/or temperatures are elevated, the portable hat system, according to the present invention, also may include a cooling duct means for enabling an adjustable amount of filtered and purified air to pass over the head of the smoker when the hat means is worn. For the convenience of the smoker, the hat means may also include pocket means for supporting at least one package of cigarettes and/or other smokers' materials for ready access thereto. In addition, to further please nearby non-smokers, scent means may be provided for adding a preferred scent to the purified exhaust filtered air.

BRIEF DESCRIPTION OF THE DRAWINGS

The advantages and features of the present invention will appear from the following description when considered in conjunction with the accompanying drawings in which.

DETAILED DESCRIPTION

Figure 1:
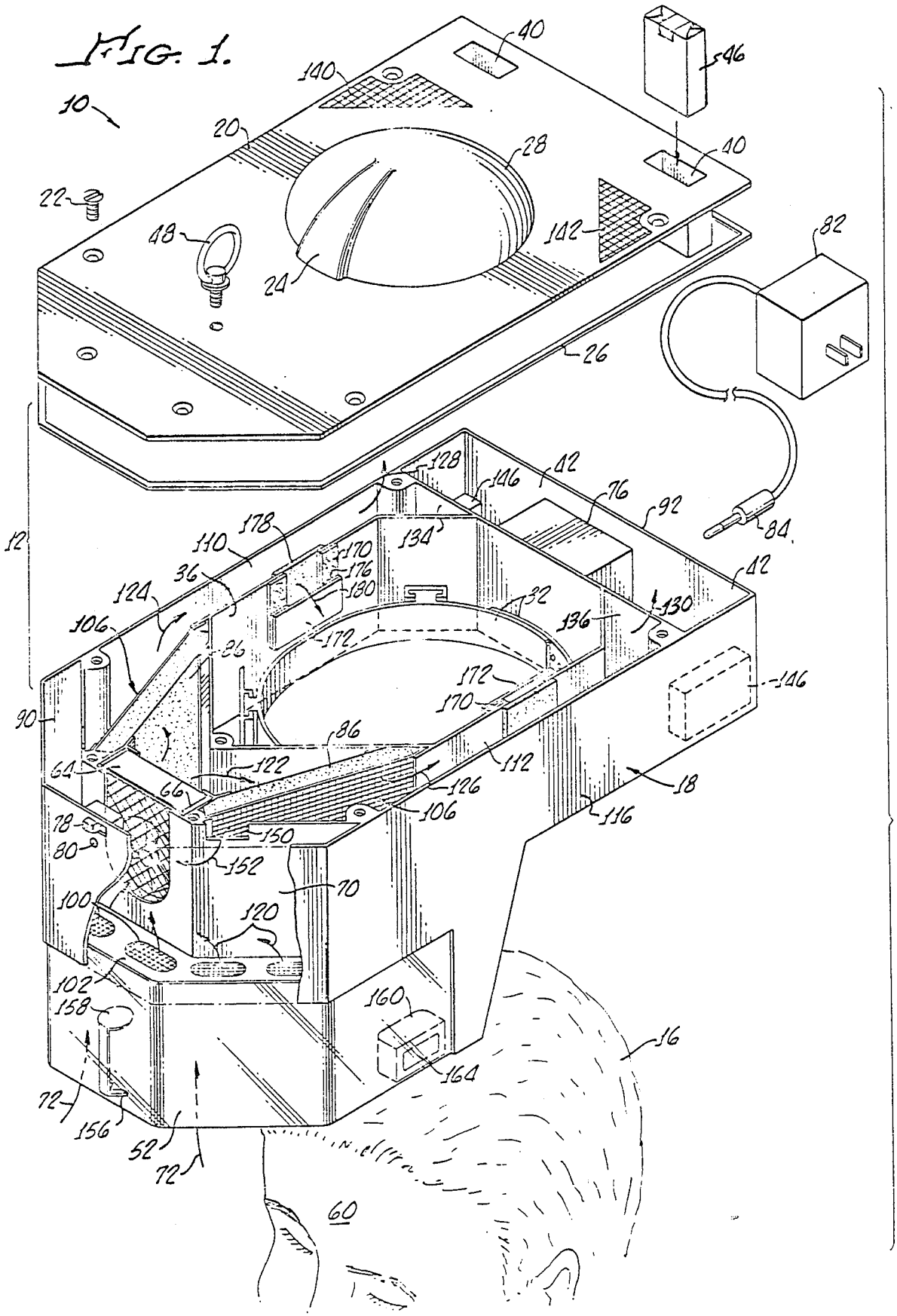
FIG. 1 is an exploded perspective view of the present invention.
Figure 2:
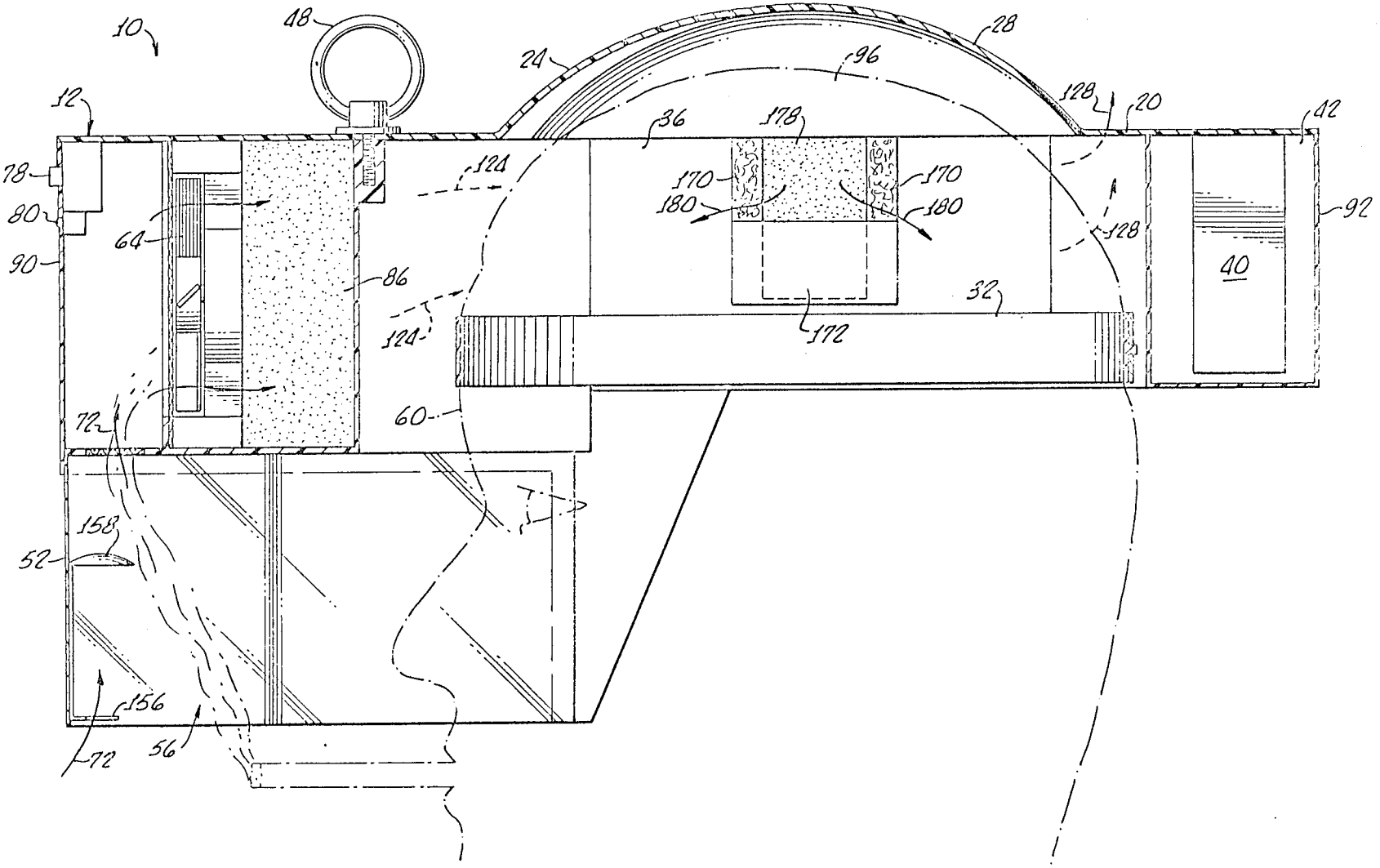
FIG. 2 is a cross-section side view showing an intake ambient air channel over the face of a smoker/user.

Turning now to FIGS. 1 and 2, there is shown a portable hat system 10, in accordance with the present invention, which generally includes a smoker's hat 12. Specifically, the hat 12 may include a housing 18 and a lid 20 which may be assembled in a conventional manner by screws 22, or the like, with a pliable seal 26 therebetween to form an airtight seal therebetween The housing 18 and the lid 20 may be molded from any suitable material, such as plastic, and further, the lid 20 may be reinforced in any suitable manner, such as with a rib 24, to provide hard hat means for preventing injury to the smoker's head from falling objects (not shown) when the hat means is worn by the smoker.

A domed portion 28 may be molded into the lid to accommodate the protection of the smoker's head.

Individualized comfort and ease of wear is enabled by an adjustable harness 32 which may be removable attached to an interior wall 36 of the housing 18 in a conventional manner, the harness being of well-known conventional type, such as those used in helmets and the like, and adjustable for accommodating various head sizes.

Openings 40 in the lid 20 along with compartments 42 formed in the housing 18 provide pocket means for supporting at least one package of cigarettes 46 for ready access thereto and/or other smoking materials.

Optionally, a ring 48 may be attached to the lid 20 in order to hang the portable hat system 10 in a convenient storage location when not in use and/or while recharging the battery.

A perimeter lens 52, which may be removably attached to the housing 18 in any conventional manner, provides visor means for establishing an intake ambient air channel 56 over the face 60 of the smoker 16. (See FIG. 2).

It should be appreciated that the perimeter lens may be made of any suitable clear material to enable visibility therethrough or, it may be tinted. In fact, a plurality of perimeter lenses may be provided with different degrees of tint, with the selection of the lens used being made in accordance with the user's preference.

A battery driven fan 64 may be cushioned 66 mounted to an interior partition 70 of the housing 18 which provides means for intaking ambient air into the hat 12, with the ambient air flowing in front of the smoker's face 16, as shown by the arrow 72. In this manner, exhaled smoke is drawn upwardly and through the fan 64. The fan 64 may be of any suitable type and the cushions 64 ensure silent and vibration absorbing operation thereof. Power for the fan is provided by an optionally rechargeable battery pack 76 interconnected with the fan 64 by on/off switch 78, which may also incorporate a charging light 80 for indicating when the rechargeable battery pack 76 is being recharged by a DC power supply 82, which may be interconnected with the battery pack 76 by a common type connector 84, as well known in the art.

The sizing of the fan 64 and the battery pack 76 will, of course, vary upon the intended duty cycle of the portable hat system and may be easily determined by one skilled in the art. Importantly, however, since the fan 64, along with filter/deodorizer packs 86, hereinafter described in greater detail, and battery pack 76 comprise the heaviest elements of the portable hat system 10, the fan 64 and the filter packs 86 are disposed near one end, such as the front 90, of the portable hat system, while the battery pack 76 is disposed near the rear 92 of the portable hat system. This positioning balances the weight of the portable hat system 10 and thereby cause the center of gravity thereof to be near the center 96 of the smoker's head when the hat 12 is worn by the smoker 16.

Because there may be a remote possibility of flyash entering the fan 64 and filter packs 86, a cinder guard 100 may be integrally disposed in a horizontal partition 102 to provide means for preventing large and burning combustion products of a predetermined size from entering the fan and the removable filter cartridge 86. The cinder guard screen may be of any suitable small gauge and is preferably formed from a metal in order to rapidly cool any impinging hot flyash or still burning particles of tobacco. This safety feature minimizes the possibility of unwanted combustion occurring in the filter packs 86 due to hot or ignited flyash.

In addition to the filter packs 86, electrostatic screens 106 contained between an outer wall 116 of the housing and inner wall 36 provide means for neutralizing residual combustion products, such as positively charged smoke particles in the intake ambient air.

The filter packs, or cartridges, may be of any suitable type well known in the art for removal of particulate cigarette combustion products and may include a layer of activated charcoal to deodorize the products of combustion. The electrostatic screens 106, which are interconnected to the cathode (not shown) terminal of the battery pack 76 also provide a well known method for converting positively charged ions in the exhaled smoke, into non-aggressive, non-clinging negative ions.

In operation, ambient air is drawn in front of the face 60 of the smoker 16 in the direction of the arrow 72 passes through the cinder guards 100 and enters the fan 64 as indicated by the arrows 120. Thereafter, the air is forced by the fan 64 into the filter packs 86 as shown by the arrow 122 where particulate matter is removed by filter packs 86, deodorized by activated charcoal and deionized by the electrostatic screens 106.

Thereafter, the filtered and purified air passes through ducts 110, 112, shown by the arrows 124, 126 and is ultimately exhausted upwardly, shown by arrows 128, 130 by inner back panels 134, 136 and through exhaust screens 140, 142. Thus, it is apparent that the back panels 134, 136, in combination with the exhaust screens 140, 142 provide means for exhausting filtered air from the hat means in an upward direction when the hat 12 is worn by the smoker 16. As a result, the filtered and purified air which has been also deionized by the cathodically charged screen 106 is returned to the ambient air in a manner such that nearby persons, even those in back of the smoker, are not disturbed by the movement or quality of the exhaust air. Optionally, scent packs 146 may be provided to add any preselected scent to the filtered and purified air as may be desired by the user thereof. The scent packs may be of any suitable type well known in the potpourri art and disposed in the flow of filtered air indicated by the arros 128, 130, or adjacent thereto as shown in FIGS. 1 and 2, depending upon the amount of added scent desired.

As an additional feature, air recycle ports 150 may be provided in the interior partition 70 which provides recirculation means for enabling at least a portion of the intake ambient air to pass through the removable filtered cartridge units 86 more than once. As shown in FIG. 1, during operation, a portion of the air passing through the filters 86 is drawn by the fan 64 through the recirculation port 150, shown by the arrow 152. This partial recycling of purified air has the advantage in increasing the differential pressure across the filters for greater filter life and further polishing discharged air between exhaled puffs of air by the smoker.

In order to provide a total smoking environment for the cigarette smoker, a cigarette or cigar clip 156 provides means for supporting a lit cigarette or cigar under the hat 12. The clip may include a heat shield 158 and is removably attached to the lens/visor 52 in a conventional manner, such as by Velcro or the like. Thus, staging means are provided for supporting a lit cigar or cigarette within the air channel 156, in order that smoke rising therefrom is carried into the hat 12 by the fan 64. Additionally, a cup 160 provides receptacle means which is removably attached to the lens/visor 52 by Velcro 164, or the like, for receiving solid smoking products, i.e., ashes and butts.

It should be appreciated that several Velcro pads 164 may be disposed within the lens/visor example, on the right and left hand sides, for accommodating the personal habits of the smoker.

Hence, it is obvious that the cigarette smoke, ashes and butts therefrom may be totally captured within the environment provided by the portable hat system 10. Not only can a person smoke any cigar or cigarette, but can hold or stage these within the intake ambient air channel 56 and dispose of ashes and butts in the removable cup 160, which is also within the intake ambient air channel 56.

Under warm conditions, cooling of the smoker's head 16 is provided by adjustable ports or tabs 170, 172 in the inner wall 36 which may be opened or removed in order to provide cooling duct means for enabling apreselected amount of filtered air to pass over the smoker's head 16. The tabs or ports may be held in either an open or closed position by Velcro 176 and, further, the size of the opening maybe adjusted by the amount of tab or port openings. As shown in FIG. 1, opening of the tab 172 enables air flow in the direction of arrow 180 to flow over and cool the smoker's head 16. As an additional feature, activated charcoal pads 178 may be provided to further filter and/or deodorize the air passing over the head of the user/smoker.

Although there has been described hereinabove a specific arrangements for a portable hat system, in accordance with the present invention, for the purpose of illustrating the manner in which the invention may be used to advantage, it should be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. A portable hat system for enabling the smoking of tobacco-type products without affecting the environment comprising:

hat means for covering the head of a smoker;

means for intaking ambient air into the hat means, the intake ambient air flowing in front of the smoker's face when the hat is worn by the smoker;

separate filter means for removing combustion products released by the smoker into the intake ambient air to produce filtered air; and means for exhausting the filtered air from the hat means.

2. The portable hat system according to claim 1, further comprising a visor dependingly attached to said hat means and covering the face of the smoker when the hat means is worn by the smoker.

3. The portable hat system according to claim 2 further comprising staging means for supporting a lit cigarette under the hat means in a position enabling the intake ambient air to flow therepast.

4. The portable hat system according to claim 3 further comprising receptacle means disposed under said hat means for receiving solid combustion products, said receptacle means being disposed in a position enabling the intake ambient air to flow therepast.

5. The portable hat system according to claim 4 wherein said hat means comprises hard hat means for preventing injury to the smoker's head from falling objects when the hat means is worn by the smoker.

6. The portable hat system according to claim 5 wherein the means for intaking ambient air includes a battery operated fan and a battery, said fan and battery being disposed in opposite ends of the hat means in order to balance the weight of the portable hat system and cause the center of gravity thereof to be near the center of the smoker's head when the hat means is worn by the smoker.

7. The portable hat system according to claim 6 wherein the means for removing combustion products from the intake ambient air comprises an electrostatic cathode screen, a removable filter cartridge and duct means for directing intake ambient air and combustion products past the electrostatic cathode screen and through the removable filter cartridge.

8. The portable hat system according to claim 7 wherein the means for intaking ambient air comprises cinder guard screen means for preventing solid combustion products of a predeteremined size from entering the fan and removable filter cartridges.

9. The portable hat system according to claim 8 means for removing combustion products from the intake ambient air further comprising recirculation means for enabling at least a portion of the intake ambient air to pass through the removable filter cartridge more than once.

10. The portable hat system according to claim 9 further comprising cooling duct means for enabling a preselected amount of filtered air to pass over the head of the smoker when the hat means is worn.

11. The portable hat system according to claim 10 wherein the hat means further comprises pocket means for supporting at least one package of cigarettes for ready access thereto.

12. The portable hat system according to claim 11 further comprising means for adding a scent to the filtered air.

13. A portable hat system for enabling the smoking of cigarettes without discharge of smoke to the ambient air and ashes to the surrounding area comprising:

hat means for covering the head of a smoker;

visor means removably attached to said hat means for establishing an intake ambient air channel in front of the face of a smoker when the hat means is worn thereby;

means for intaking ambient air into the hat means through the air channel when the hat means is worn by the smoker;

means for removing smoke released by the smoker into the air channel to produce filtered air;

means for exhausting the filtered air from the hat means;

staging means, attached to said visor means, for supporting a lit cigarette within the air channel in order that smoke rising therefrom is carried into the hat means via the intake ambient air; and receptacle means removably attached to said visor means for receiving solid combustion products.

14. The portable hat system according to claim 13 wherein said visor means is adapted to enable attachment of the receptacle means thereto at more than one location.

15. The portable hat system according to claim 14 wherein the means for intaking ambient air includes a battery operated fan and a rechargeable battery, said fan and battery being disposed in opposite ends of the hat means in order to balance the weight of the portable hat system and cause the center of gravity thereof to be near the center of the smoker's head when the hat means is worn by the smoker.

16. The portable hat system according to claim 15 wherein the means for removing smoke from the intake ambient air comprises an electrostatic cathode screen, a removable filter cartridge and duct means for directing intake ambient air and smoke past the electrostatic cathode screen and through the removable filter cartridge.

17. The portable hat system according to claim 16 wherein the means for intaking ambient air comprises circular guard screen means for preventing solid combustion products of a predetermined size from entering the fan and removable filter cartridges.

18. The portable hat system according to claim 8 means for removing smoke from the intake ambient air further comprises recirculation means for enabling at least a portion of the intake ambient air to pass through the removable filter cartridge more than once.

19. The portable hat system according to claim 18 further comprising cooling duct means for enabling a preselected amount of filtered air to pass over the head of the smoker when the hat means is worn.

20. The portable hat system according to claim 19 wherein the hat means further comprises pocket means for supporting at least one package of cigarettes for ready access thereto.

21. The portable hat system according to claim 20 wherein said hat means comprises hard hat means for preventing injury to the smoker's head from falling objects when the hat means is worn by the smoker.

22. The portable hat system according to claim 21 further comprising means for adding a scent to the filtered air.

23. The portable hat system according to claim 22 wherein the means for exhausting the filtered air from the hat means is configured for exhausting the air in an upward direction when the hat means is worn by a smoker.

* * * * *